US006125854A

United States Patent [19]

Kastner

[11] Patent Number: 6,125,854

[45] Date of Patent: Oct. 3, 2000

[54] METHOD FOR PACKAGING TUBULAR ARTICLES

[75] Inventor: Arnold Kastner, Montreal, Canada

[73] Assignee: CTC Tube Company of Canada Inc., Montreal, Canada

[21] Appl. No.: 09/478,895

[22] Filed: Jan. 7, 2000

Related U.S. Application Data

[62] Division of application No. 08/936,812, Sep. 24, 1997.

[30] Foreign Application Priority Data

Sep. 26, 1996 [CA] Canada ..... 2186551

[51] Int. Cl.[7] ..... A24C 5/02; A24C 5/35

[52] U.S. Cl. ..... 131/283; 131/70; 53/148; 53/149; 53/150; 53/236; 53/242; 53/243; 206/242

[58] Field of Search ..... 53/148, 149, 150, 53/236, 242, 243; 131/70, 283, 282, 105; 206/242

[56] References Cited

U.S. PATENT DOCUMENTS

| | | | |
|---|---|---|---|
| 1,606,834 | 11/1926 | Halank . | |
| 1,750,018 | 3/1930 | Meyer-Jagenberg | 131/283 |
| 2,919,529 | 1/1960 | Hillman | 53/148 |
| 3,004,374 | 10/1961 | Pembroke | 53/148 |
| 3,267,641 | 8/1966 | Molins | 53/148 |
| 3,365,857 | 1/1968 | Liedtke | 53/148 |
| 3,603,445 | 9/1971 | Hamburg | 198/31 |
| 3,895,479 | 7/1975 | Kastner . | |
| 4,044,526 | 8/1977 | Lafleur . | |
| 4,083,460 | 4/1978 | Venturi | 53/150 |

*Primary Examiner*—Stanley S. Silverman
*Assistant Examiner*—Jacqueline A Ruller
*Attorney, Agent, or Firm*—McFadden, Fincham; Adrian Zahl; Ian Fincham

[57] ABSTRACT

A method for packing unfilled cigarette tubes into a receptacle consists of the steps of feeding tubes to a conveyor, moving the tubes along the conveyor to a holding position, and laterally moving a predetermined number of tubes to a container. The container may then be pivoted vertically to deposit the tubes into the receptacle.

4 Claims, 3 Drawing Sheets

METHOD FOR PACKAGING TUBULAR ARTICLES

RELATED APPLICATIONS

This is a divisional application of U.S. application Ser. No. 08/936,812, filed on Sep. 24, 1997.

FIELD OF THE INVENTION

The present invention relates to a method for packaging tubular articles and, particularly unfilled filter tipped cigarette tubes or cylinders. More particularly, the invention relates to a multiple stage apparatus which avoids handling of the tubes by packaging personnel. This is a divisional of application Ser. No. 08/936,812.

BACKGROUND OF THE INVENTION

Since the advent of substantial increases in the cost of tailor made cigarettes, a significant number of smokers have resorted to making their own, using loose tobacco and cigarette tubes. Accordingly, there has been an increased need for cigarette tubes and there is a need in the tube manufacturing industry to have an apparatus which, cost effectively, packages such tubes. Also cigarette tubes are used in large numbers by the cigarette manufacturing industry, where cigarette tubes are commercially filled in large numbers.

Compared to a commercially made cigarette, a filter tip cigarette tube is quite fragile. A commercial, filled, cigarette is entirely solid whereas a cigarette tube is hollow for a considerable portion of its length. With commercial cigarettes being solid, quality control sensors and other detecting devices that apply pressure, or use the weight/density factor are readily usable, but cannot be used for cigarette tubes, and particularly filter tipped cigarette tubes, as these are "uneven" or "unbalanced".

As an example, a filter tipped cigarette tube can have about 80% of its length hollow, or empty, with the remaining about 20% being filled by the filter plug. There is therefore considerable difference between the structure of the filled cigarette and the filter tipped cigarette tube. A typical container holding 10,000 tubes has a total weight of about 8.25 pounds, whereas a container holding 10,000 commercial cigarettes weighs about 50 pounds.

Due to the lack of "body" in filter tipped cigarette tubes, except for the filter plug area, they are very fragile and are easily distorted or crushed. This causes problems by users, as a crushed or creased tube is difficult to mount on the tube nozzle of the injection type cigarette making machine.

U.S. Pat. No. 3,004,374 discloses an apparatus for collecting cigarettes in receptacles. Generally, the reference teaches an apparatus in which cigarettes are transported through a series of mechanical and manual stages involving extensive manipulation of the cigarette. Such manipulation does not substantially affect a filled cigarette tube. However, the same treatment results in dents and creases in the tubes and therefore is prohibitive for delicate cigarette tubes. Accordingly, the apparatus disclosed by Pembroke in U.S. Pat. No. 3,004,374, is not useful for packaging cigarette tubes.

U.S. Pat. No. 3,365,857, further relates to an apparatus for collecting and manipulating rows of rod-shaped articles and more particularly, cigarettes. The apparatus is primarily employed for stacking rows of cigarettes into trays and includes quality control means. The reference does not teach a packaging apparatus (such as disclosed herein) adapted to automatically position a charge of cigarette tubes into a carton therefor, via a lateral injection means, without damaging the tube.

Further, Hillman, in U.S. Pat. No. 2,919,529, teaches an improved apparatus for collecting cigarettes in receptacles. The apparatus is specifically designed for use in manipulating cigarettes, cigars and the like articles which contain a charge of tobacco by injecting needles into the cigarette, etc. In view of this, the Hillman reference does not contemplate a device for manipulating hollow cigarette tubes for packaging the same.

There is still required a high speed, high efficiency method and apparatus for loading cigarette tubes into a receptacle without damaging the tubes, while further reducing the extent to which the tubes are handled either mechanically or manually. The present invention clearly addresses these requirements and, in one aspect provides an apparatus for packaging cigarette tubes in a receptacle from a supply source, comprising advancing means for moving a predetermined number of cigarette tubes from the supply source; accumulator means in operative association with the advancing means for accumulating the predetermined amount to be packed into a concentrated volume; and transfer means for transferring the concentrated volume of tubes into the receptacle.

SUMMARY OF THE INVENTION

It is an object of the present invention to supply cigarette tubes to a conveyor in a manner that ensures the tubes rest against each other on the conveyor but at the same time avoiding pyramiding, that is piling on top of each other. This ensures correct orientation. Predetermined numbers or "lots" of tubes are separated and then moved to a holding area in a multi-layer condition, where the tubes are moved sideways into a box.

In one aspect, the present invention comprises a method of packing unfilled cigarette tubes into a receptacle, comprising the steps of:

feeding cigarette tubes to a conveyor;

moving a predetermined number of tubes along the conveyor to a holding position; and transferring the predetermined number of tubes from the holding position laterally to a containment member.

Preferably, the method includes the further step of rotating a filled containment member about a vertical axis away from the holding position. Optionally, a receptacle may be positioned over the filled containment member and said filled containment member and said receptacle pivoted about a horizontal axis. Optionally, a table or other support member may be positioned beneath said containment member to receive said receptacle as said containment member is pivoted, and said support member lowered to remove said receptacle from said containment member, said cigarette tubes falling into said receptacle.

The invention will be readily understood by the following description of certain embodiments, by way of example, in conjunction with accompanying drawings.

DETAILED DESCRIPTION OF THE PREFERRED EMBODIMENTS

Figure 1:
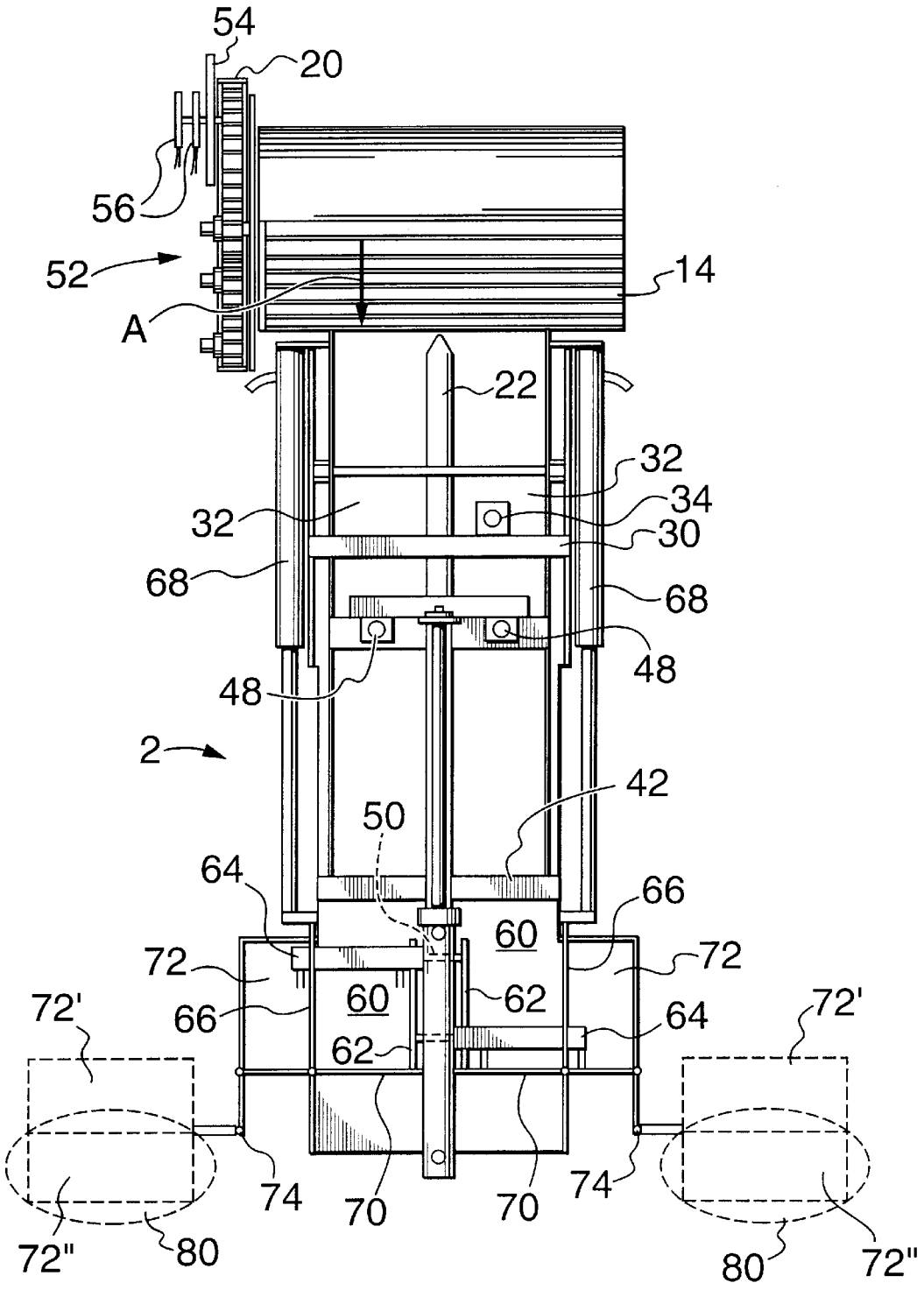
FIG. 1 diagrammatically illustrates in plan form, one form of apparatus in accordance with the invention, with a feed drum omitted for clarity.
Figure 2:
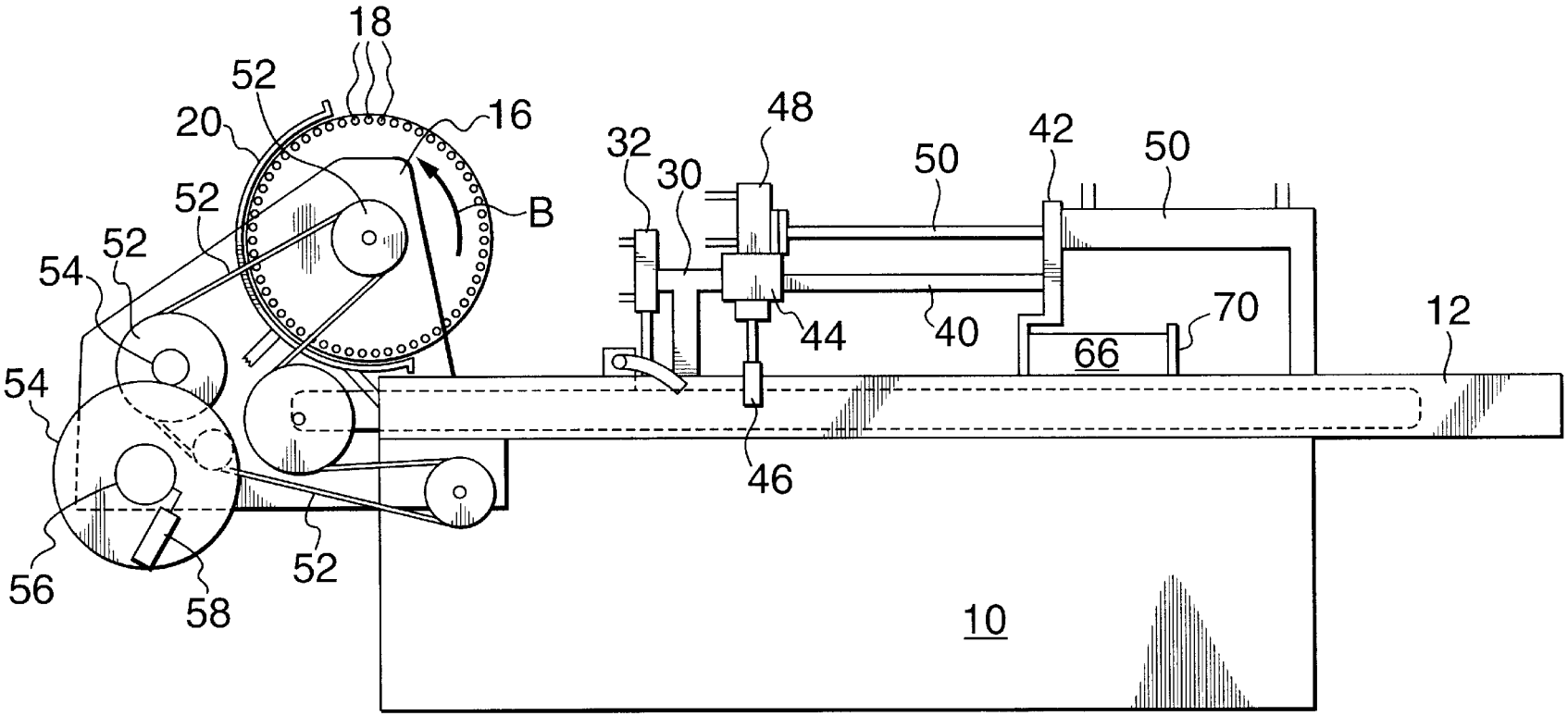
FIG. 2 is a side view in the direction of arrow 2 in FIG. 1.

As diagrammatically illustrated in FIGS. 1 and 2 a packing apparatus specifically for packing cigarette tubes, has a support base 10 on which are mounted a framework having spaced apart parallel frame members 12. Between the frame members 12 is mounted a conveyor 14. In FIG. 2 is shown a feed drum 16, positioned over one end of the conveyor. Feed drum 16 is more particularly described in co-pending Canadian published application Ser. No. 2,186,442, filed on Sep. 26, 1996.

The conveyor 14 moves as indicated by the arrow A of FIG. 1, and the drum 16 rotates as indicated by arrow B, FIG. 2. Cigarette tubes are fed to the top of the drum, into axially extending grooves 18 in the drum periphery and are carried round and dropped in a single layer on the conveyor. A curved flap 20 extends round the rear of the drum to ensure the cigarette tubes remain in the grooves.

In the example of FIGS. 1 and 2, two rows of tubes are deposited on the conveyor, which is divided into two sections by a central divider 22. A support member pivotally mounts a split pivoted flap 32. The flap is actuated by an actuator 34, for example a pneumatic piston, and is divided laterally into two parts, a part on each side of the divider 22. The lower end of the flap is pivoted down to just clear the conveyor when the actuator 34 is operated.

Next in line along the conveyor is a central rod 40 supported at one end from the frame members 12 by support member 30 and at the other end by support 42. Slidably mounted on the rod 40, by means of a central member 44, are two pusher members 46. The pusher members are vertically moved, up and down, by actuators, for example pneumatic rams 48. The central member 44, with the pusher or pusher members 46, is reciprocated horizontally along the rod 40 by pneumatic ram 50.

The drum 16 and the conveyor 14, are driven by toothed belt and gear arrangement 52, which also drives, via gears 54, cams 56 which actuate switches 58. The cams 56 are relatively related to the rotation of the drum 16 and can therefore actuate counters to control the various rams, etc.

Starting generally at the support 42 there is defined an accumulating or holding position, indicated at 60, one on each side of the divider. The divider 22 ends at the support 42 and in the centre are positioned two laterally movable ejecting members 62. The ejecting members 62 are reciprocated outwardly by pneumatic rams 64. The side frame members 12 are reduced in height at the holding positions and the gaps filled by blocking members 66 which reciprocate back and forth, being actuated by pneumatic rams 68 (deleted from FIG. 2 for clarity). The rear walls of the holding positions are defined by static walls 70. The holding positions are dimensioned to hold a predetermined number of cigarette tubes, for example 200 or any other selected number which is convenient.

Figure 3:
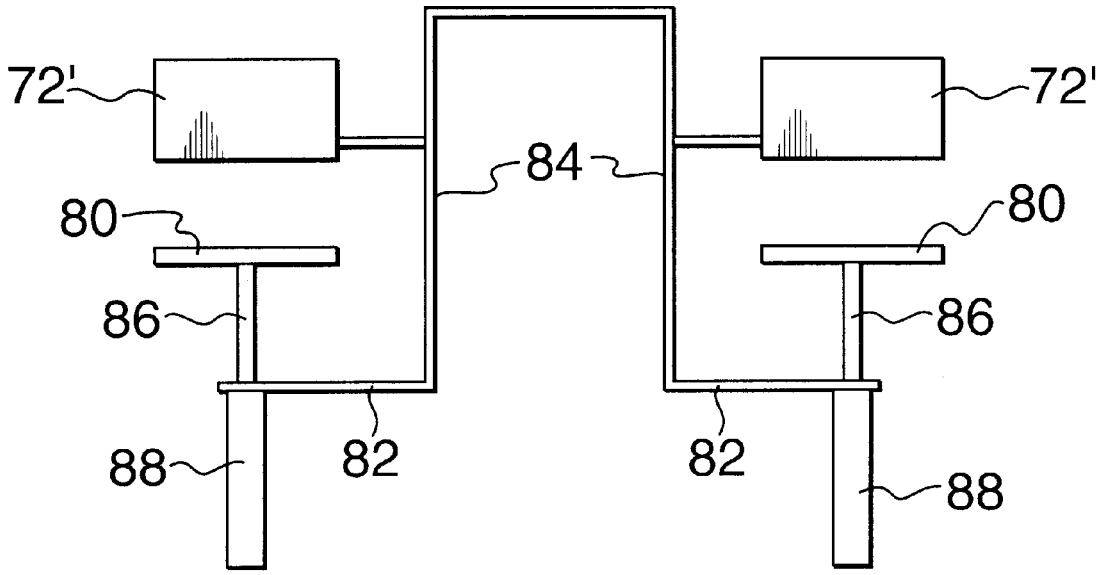
FIGS. 3 and 4 are end views illustrating the operation of receptacle or containment members for receiving articles and accepting a box or similar member.
Figure 4:
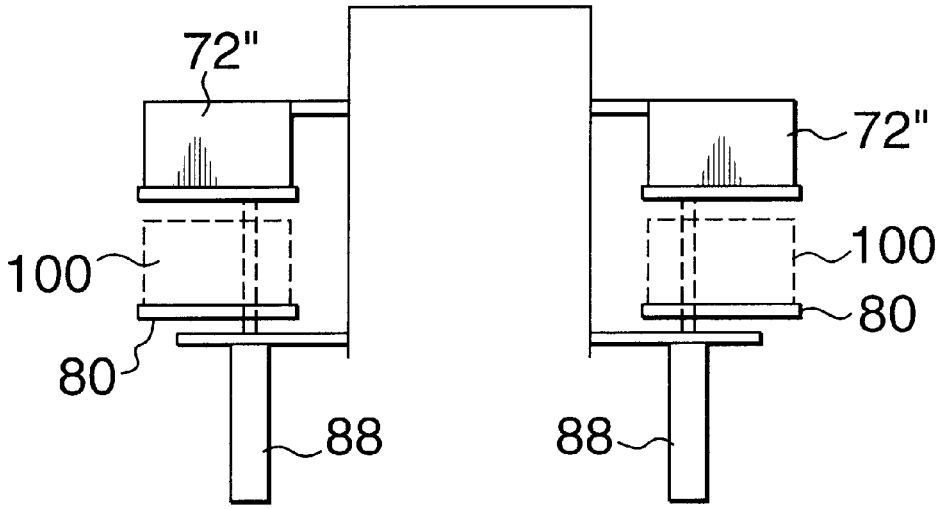

Illustrated in FIG. 1 and also in FIGS. 3 and 4, is one form of transfer means and containment means. Pivotally mounted on the frame member 12, adjacent the wall 70, are trough shaped containment members 72. The trough members are open at one side, facing towards the holding positions. The trough members can pivot outwardly about a pivot axis 74. The trough members can also be rotated about a horizontal axis extending laterally, whereby any articles in a trough member will fall out through the open side. A first, pivotal position, is shown in dotted outline in 72' and a second, rotated position, is shown in dotted outline at 72".

Positioned below the outward pivoted and rotated position of the member 72 is a vertically movable table 80, indicated in dotted outline in FIG. 2 and seen more clearly in FIGS. 3 and 4. The tables 80 are mounted on brackets 82 extending from frame 84. The tables are mounted on rods 86 vertically reciprocated by cylinders 88.

The actuation is typically as follows. The tubes are pushed laterally, by the injecting member 62, into the containment member 72. Once the injecting members have pushed the tubes into the containment members, the containment members rotate to bring the open side uppermost. The containment member then pivots to position 72'. An empty box is positioned over the containment member and then the containment member, with the box and tubes, rotates so that the containment member open side is now downwards, as seen at position 72".

The tables 80 at this stage are elevated as in FIG. 3, to receive the containment members and boxes as these pivot. The tables are such a height that as the containment members rotated down, the boxes rest on the tables. The tables then move down and the boxes, filled with tubes, separate from the containment member. The boxes are shown at 100 in FIG. 4.

While the containment members are pivoting and rotating, the injecting members 62 retract, the blocking members 66 move to close off the sides of the holding positions, the pusher members 46 have retracted and the pivoted flap is in the up position, for a further supply of tubes.

I claim:

1. A method of packing unfilled cigarette tubes into a receptacle, comprising:

feeding said cigarette tubes to a conveyor;

moving a predetermined number of said tubes along said conveyor to a holding position;

transferring said predetermined number of said tubes from said holding position laterally to a containment member;

and rotating said filled containment member about a vertical axis away from said holding position.

2. A method as claimed in claim 1, including positioning a receptacle over said filled containment member and pivoting said filled containment member and said receptacle about a horizontal axis.

3. A method as claimed in claim 2, including positioning a support member beneath said containment member to receive said receptacle as said containment member is pivoted, and lowering said support member to remove said receptacle from said containment member, said cigarette tubes falling into said receptacle.

4. A method as claimed in claim 3, wherein said support member comprises a table associated with actuation means for elevating said table to receive said receptacle and lowering said table to separate said receptacle from said containment member.

* * * * *